United States Patent [19]

Crowley

[11] Patent Number: 4,482,198

[45] Date of Patent: Nov. 13, 1984

[54] SHUNT

[75] Inventor: Daniel J. Crowley, Harrisburg, Pa.

[73] Assignee: AMP Incorporated, Harrisburg, Pa.

[21] Appl. No.: 440,110

[22] Filed: Nov. 8, 1982

[51] Int. Cl.[3] ..... H01R 31/08

[52] U.S. Cl. ..... 339/19; 339/204; 339/217 S; 339/222

[58] Field of Search ..... 339/19, 32, 33, 222, 339/217 S, 221 R, 221 M, 204, 205

[56] References Cited

U.S. PATENT DOCUMENTS

| | | | |
|---|---|---|---|
| 3,456,231 | 7/1969 | Paullus et al. | 339/60 |
| 3,486,160 | 12/1969 | Wallace | 339/17 |
| 3,594,714 | 7/1971 | Paullus et al. | 339/242 |
| 3,714,618 | 1/1973 | Appleton | 339/19 |
| 3,821,693 | 6/1974 | Dechelette | 339/217 S |
| 3,907,392 | 9/1975 | Haag et al. | 339/32 M |
| 3,932,013 | 1/1976 | Yeager et al. | 339/19 |
| 4,037,911 | 7/1977 | Anhalt et al. | 339/217 S |
| 4,084,872 | 4/1978 | Pritulsky | 339/19 |
| 4,101,192 | 7/1978 | Baverle et al. | 339/217 S |
| 4,383,724 | 5/1983 | Verhoeven | 339/19 |

*Primary Examiner*—John McQuade
*Assistant Examiner*—Thomas M. Kline
*Attorney, Agent, or Firm*—Russell J. Egan; Katherine A. Nelson

[57] ABSTRACT

The subject shunt connector has an integral housing of rigid insulative material and a single terminal mounted therein. The housing defines a pair of parallel, spaced male or pin terminal receiving passages extending between front and rear faces, and a slot interconnecting portions of the passages. The terminal has a pair of parallel contact arms interconnected at opposite ends by cross bars and a tine intermediate the arms. The terminal is so mounted in the housing that it can engage a pin terminal inserted from either face of the connector without being damaged or dislodged.

4 Claims, 4 Drawing Figures

SHUNT

The present invention relates to a shunt connector and in particular to a shunt connector which cannot be improperly mounted on a pair of adjacent pin terminals.

Terminal junction or shunt systems are well known in the electrical and electronic arts since it is frequently necessary to temporarily interconnect two or more adjacent terminals. Terminal junction wiring systems generally employ single or multiple modules in the form of a housing of rigid insulating material, conventionally of rectangular configuration, incorporating means for physically mounting the housing in a support wherein a plurality of such housings may be mounted in side-by-side fashion depending upon the number of electrical interconnection being made. Each housing is provided with a pair of terminal receiving cavities which extend in parallel spaced fashion within the housing. Conventionally the shunt terminal is generally formed by standard receptacle terminals joined by a metallic bus strip, with the bus strip being folded to draw the terminals closer together for insertion into the closely spaced cavities in the housing. This type of shunt connector has several disadvantages in that, first, it is expensive to manufacture the conventional receptacle terminals for a shunt purpose and, second, it requires additional steps to bend the carrier strip for proper spacing of the formed terminals. A further disadvantage is that there is the possibility of improper (reversed) mounting of the shunt which will result in either destruction of the shunt itself or, at the very least, an improper shunt being established.

It should further be appreciated that shunt connectors of the present type are generally used for shunting pin terminals that are on 0.100 and 0.200 inch centers. Therefore the connectors themselves are rather small making it difficult to determine which is the mounting end and which is the back end of the connector.

The present invention concerns a shunt connector having an insulative housing defining a pair of closely spaced, parallel terminal receiving passages and a single shunt terminal mounted in said housing and exposed in the passages so that good electrical and mechanical contact can be made between the shunt terminal and a pair of terminal pins inserted into the respective passages from either end thereof.

The present invention will be described by way of non-limiting example with reference to the accompanying drawings in which.

Figure 1:
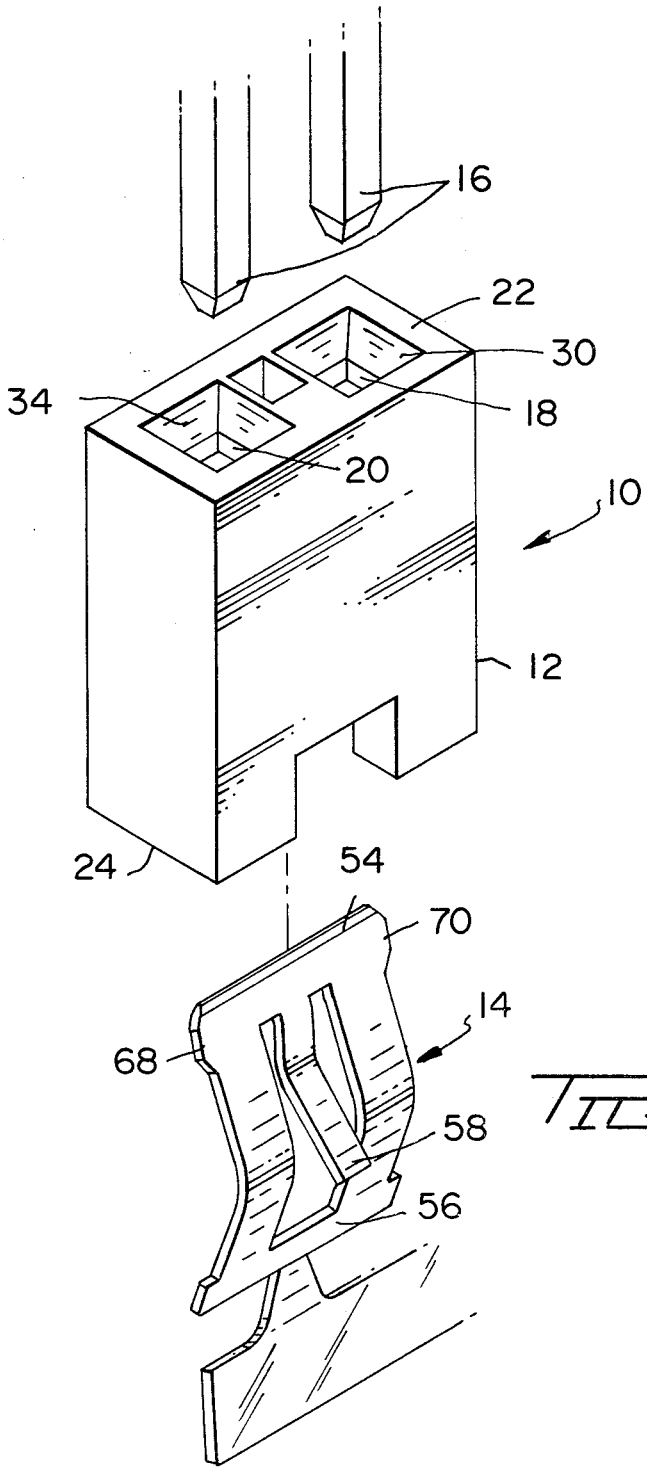
FIG. 1 is an exploded perspective view of a shunt according to the present invention.
Figure 2:
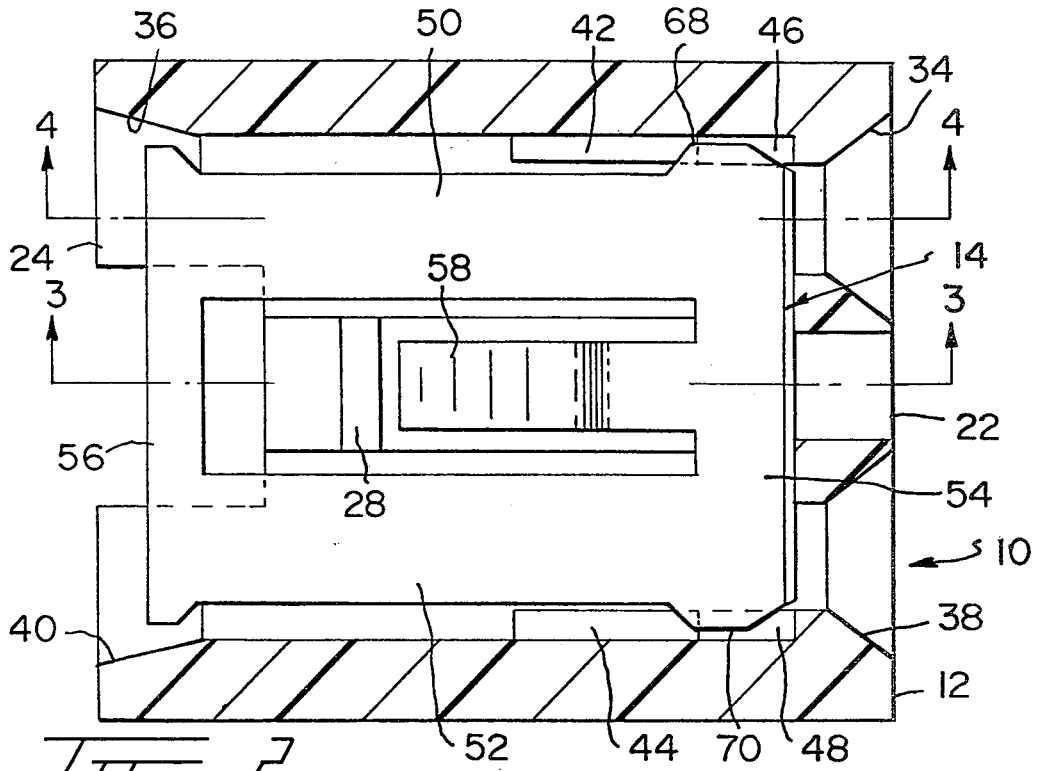
FIG. 2 is a longitudinal section taken along line FIG. 2—2 of FIG. 3.

The subject shunt connector 10 comprises a housing 12 and a terminal 14 received therein. The shunt connector is used to interconnect pairs of closely spaced pin terminals 16.

The housing 12 is an integral rectangular member of rigid plastics material defining a pair of parallel closely spaced terminal passages 18, 20 extending between a mating face 22 and an oppositely directed rear surface 24. A transverse slot 26 interconnects the passages 18, 20 within the housing and defines a lug or stop 28 projecting from a first inner wall 30 towards an opposite inner wall 32. Each passage 18, 20 has oppositely directed flared entrys 34, 36, 38, 40, respectively. Each passage 18, 20 further includes a side ramp 42, 44 forming a shelf 46, 48.

The terminal 14 is stamped and formed from a single strip of conventional conducting material and includes a pair of parallel spaced contact arms 50, 52 joined at their opposite ends by cross bars 54, 56. A latching tine 58 extends from the cross bar 54 to lie between the parallel spaced contact arms 50, 52. It will best be appreciated from FIG. 3 that the contact arms 50, 52 have a bowed longitudinal configuration with a portion 60 intermediate the cross bars 54, 56 having the maximum arc. The tine 58 has a first portion 62 which is bent in a direction opposite the contact arms and then has a portion 64 reversedly bent beyond itself so that the free end 66 extends in the direction of the contact arms. The terminal 14 also includes a pair of lateral flanges 68, 70.

The present invention is assembled by simply slipping the terminal 14 from the rear 24 of housing 12 into the passages 18, 20 and slot 26 with the cross bar 54 leading. The flanges 68, 70 will encounter and ride up ramps 42, 44 to seat on shelves 46, 48. At the same time tine 58 will ride over stop 28. This will bring the terminal into a stable position with cross bars 54 and 56 engaging wall 32 and portions 60 of the contact arms lying in the respective passages 18, 20 spaced from wall 30.

Figure 3:
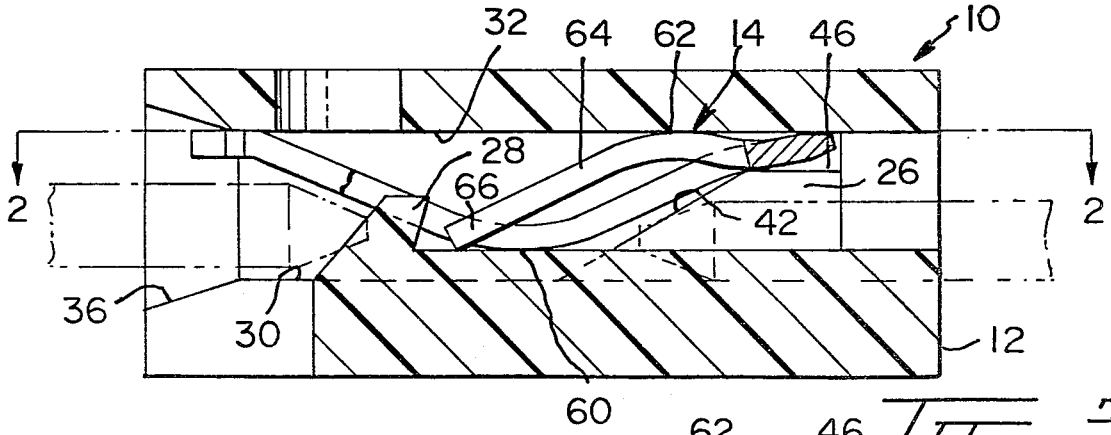
FIG. 3 is a transverse section taken along line 3—3 of FIG. 2, part of the terminal being broken away.
Figure 4:
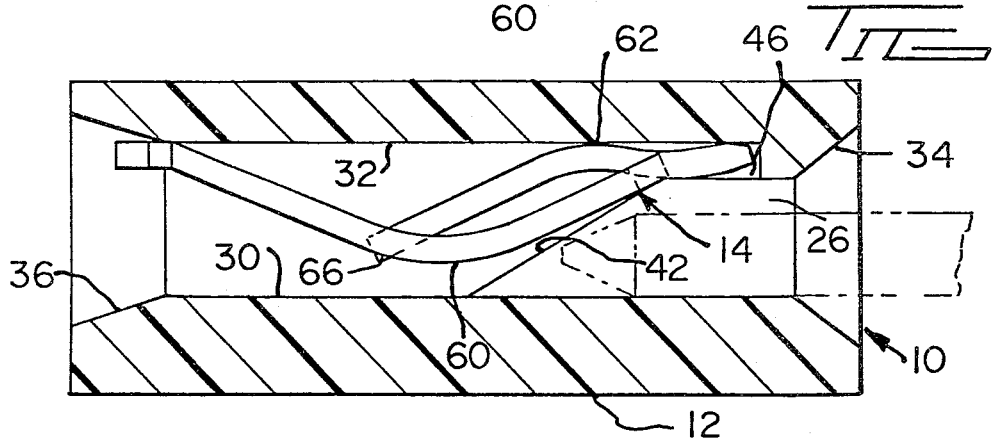
FIG. 4 is a transverse section through the housing only taken along line 4—4 of FIG. 2.

It will be appreciated from a comparison of FIGS. 3 and 4 that the tine 58 engaging with the lug 28 will prevent the terminal 14 from being displaced from the housing 12 by a terminal entering from mating face 22. It will also be apparent from these Figures that because the contact arms 50, 52 are bowed and lie in the respective passages 18, 20 that a pin terminal 16 can be received in the subject shunt connector from either the mating 22 or rear 24 ends thereof without damaging or displacing the terminal 14.

I claim:

1. A shunt connector comprising:

an integral housing of rigid insulative material having an overall rectangular profile defining therein a pair of closely spaced terminal passages extending from a front mating face to an oppositely directed rear face, a slot interconnecting portions of said passages and defining a lug intermediate the passages; and a terminal receivable in said housing, said terminal having first and second parallel spaced contact arms joined at each end thereof by transverse cross bar portions, a latching tine extending from one cross bar to lie intermediate and parallel to the contact arms, said contact arms each having a longitudinal bowed configuration intermediate said cross bar portions, said terminal being mounted in said housing with said cross bar portions engaging one wall, said contact arms lying in respective passages directed toward an opposite wall, and said latching tine engaging said lug, whereby mating pin terminals can be inserted into said shunt connector from either face without dislodging or damaging said terminal.

2. A shunt connector according to claim 1 further comprising:

a shoulder formed toward one end of each side wall of each said passage spaced from said one wall; and an outwardly directed flange forming a continuation of said cross bar portion to each side of one end of said terminal, said flanges engaging respective shoulders to position and stabilize said terminal in said housing.

3. A shunt connector comprising an integral housing of insulative material having an overall rectangular profile defining a pair of closely spaced parallel terminal passages, a slot partially interconnecting said passages and defining a lug intermediate the passages; and a terminal receivable in said housing and having first and second parallel spaced contact arms joined at each end thereof by transverse cross bar portions, a latching tine extending from one cross bar to lie intermediate of and parallel to the contact arms, said contact arms each having a longitudinal bowed configuration intermediate the cross bar portions, characterized by means mounting said terminal in said housing with said cross bar portions engaging one interior wall and said contact arms lying in respective passages bowed toward an opposite interior wall and said latching tine engaging said lug whereby pin terminals can be inserted from either face without dislodging or damaging said terminal.

4. A shunt connector according to claim 3 wherein said mounting means is characterized by a groove in an side wall of each said passage at one end thereof and adjacent said one interior wall and an outwardly directed integral flange at one end of said terminal, each said flange being received in a respective groove.

* * * * *